US007316143B2

(12) United States Patent
Kondo et al.

(10) Patent No.: US 7,316,143 B2
(45) Date of Patent: Jan. 8, 2008

(54) SEAMLESS STEEL TUBES AND METHOD FOR PRODUCING THE SAME

(75) Inventors: Kunio Kondo, Osaka (JP); Yuji Arai, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/592,782

(22) Filed: Nov. 3, 2006

(65) Prior Publication Data

US 2007/0101789 A1 May 10, 2007

Related U.S. Application Data

(63) Continuation of application No. PCT/JP2005/008357, filed on May 6, 2005.

(30) Foreign Application Priority Data

May 7, 2004 (JP) ..... 2004-138825

(51) Int. Cl.
*B21B 19/04* (2006.01)

(52) U.S. Cl. ..... 72/97; 72/700; 148/333; 148/593

(58) Field of Classification Search ..... 72/97, 72/700; 420/104, 128; 148/590, 593, 333
See application file for complete search history.

(56) References Cited

U.S. PATENT DOCUMENTS 4,702,778 A 10/1987 Takahashi et al.
6,126,897 A * 10/2000 Aihara et al. ..... 420/106
6,540,848 B2 * 4/2003 Miyata et al. ..... 148/336
6,846,371 B2 * 1/2005 Miyata et al. ..... 148/593
7,048,811 B2 * 5/2006 Ohgami et al. ..... 148/330

FOREIGN PATENT DOCUMENTS

EP 1 069 201 A2 1/2001
EP 1 119 648 B1 12/2004
JP 04-314842 11/1992

(Continued)

OTHER PUBLICATIONS

International Search Report dated Aug. 2, 2005 from corresponding international application PCT/JP2005/008357, 2 pages.

(Continued)

*Primary Examiner*—Ed Tolan
(74) *Attorney, Agent, or Firm*—Marshall, Gerstein & Borun LLP

(57) ABSTRACT

A seamless steel tube comprising, in mass %, C: 0.30 to 0.50%, Si: 0.5% or less, Mn: 0.3 to 2.0%, P: 0.025% or less, S: 0.005% or less, Cr: 0.15 to 1.0%, Al: 0.001 to 0.05%, Ti: 0.005 to 0.05%, N: 0.02% or less, B: 0.0005 to 0.01% and O (oxygen): 0.0050% or less, wherein Beff defined in following equation (a) or (b) takes a value of 0.0001 or more, where Beff=B−10.8×(N−14×Ti/47.9)/14—(a) when Neff=N−14×Ti/47.9≧0, and Beff=B—(b) when Neff=N−14×Ti/47.9<0, thus enabling to provide seamless steel tubes having excellent cold workability, hardenability, toughness and torsion fatigue strength and being most suitable for hollow shaft blanks for use in making one-piece type hollow drive shafts as well.

8 Claims, 4 Drawing Sheets

FOREIGN PATENT DOCUMENTS

| | | |
|---|---|---|
| JP | 06-341422 | 12/1994 |
| JP | 07-018330 | 1/1995 |
| JP | 07-088537 | 4/1995 |
| JP | 08-073938 | 3/1996 |
| JP | 10-95589 | 7/1998 |
| JP | 10-310823 | 11/1998 |
| JP | 2864997 | 12/1998 |
| JP | 11-217649 | 8/1999 |
| JP | 11-302785 | * 11/1999 |
| JP | 2000-204432 | 7/2000 |
| JP | 2001-355047 | 12/2001 |
| JP | 2003-090325 | 3/2003 |
| WO | WO 2006/104023 A1 | 10/2006 |

OTHER PUBLICATIONS

Translated International Preliminary Report on Patentability issued Nov. 14, 2006 in corresponding PCT/JP2005/008357.

Translated Written Opinion issued Nov. 14, 2006 in corresponding PCT/JP2005/008357.

Supplementary European Search Report mailed Aug. 28, 2007 in corresponding EP application No. 053737060.2, 3 pages.

* cited by examiner

SEAMLESS STEEL TUBES AND METHOD FOR PRODUCING THE SAME

BACKGROUND OF THE INVENTION

The present invention relates to seamless steel tubes to be used as hollow shaft blanks which are better fitted to reduce the weight of drive shafts used in automobiles, and more particularly to seamless steel tubes having excellent, cold workability, hardenability, toughness and torsion fatigue strengths as well as being most suitable as starting materials for making hollow drive shafts by applying heat treatment subsequent to cold swaging of both ends thereof, and a method for producing the same.

From the view point of global environment protection, it is highly demanded to reduce the weight of car-body to improve the fuel efficiency. In this regard, there have been various trials that solid members among automobile parts are replaced with hollow members. In these trials, a drive shaft which transmits the driving force to the wheel is also attempted to be made from a hollow blank.

The purpose of making automobile parts to have a hollow structure is not only to reduce the weight thereof but also to expectedly improve an acceleration response owing to the enhancement of torsion stiffness and to expectedly control an indoor quietness in a moving car owing to the improvement of vibration characteristics as well, which is expected to be fulfilled at any rate, and a strong demand for developing hollow shafts processed in a special shape is growing in association with the fulfillment thereof.

For instance, in a design that both shaft ends are securely fixed to constant-velocity joints, an intermediate portion of the shaft is thin in wall thickness and has a large diameter as much as possible, whereby not only the torsion stiffness is enhanced but also the vibration characteristics are improved. In the meantime, by setting the diameter of both shaft ends—to be securely fixed to constant-velocity joints—to be equal to the diameter of solid members which have been used to date, existing constant-velocity joints can be utilized as they are.

As a manufacturing method of hollow drive shafts, there is a method that a hollow or solid shaft is securely fixed to both ends of a hollow tube blank by means of friction welding or the like. However, this method cannot be applied for the case that the hollow portion has a large diameter but the diameter at both ends is small. By reason mentioned above, in order that a drive shaft may be formed in such a manner that an intermediate portion thereof is configured to have a thinner wall thickness and larger diameter as much as possible and the diameter at both ends is small, it is attempted to make one-piece type hollow drive shafts by applying following procedure: steel tube blanks are subjected to cold working for wall thinning in the intermediate portion thereof; and subsequently, both ends of steel tube blanks are subjected to cold reducing etc. to not only reduce the tube end outside diameter but also increase the wall thickness at both ends.

Meanwhile, the one-piece type hollow drive shaft mentioned above is subjected to complex cold working so as to be formed into the specialized unique shape. Accordingly, when welded tubes are used as steel tube blanks to make hollow drive shafts, there is an issue that any cracking should occur along the weld line during forming operation and/or any fatigue crack develops along the weld line in the fatigue test to be conducted after forming operation. Thus, at present there is insufficient reliability in using welded tubes as hollow shaft blanks for making hollow drive shafts.

Therefore, to prevent any cracking during a forming operation by means of cold working and to secure sufficient torsion fatigue strengths after a forming operation, there is a growing demand for using seamless steel tubes as hollow blanks for making one-piece type hollow drive shafts. To respond to the demand, there are proposed hollow drive shafts adopting seamless steel tubes as hollow shaft blanks.

When one-piece type hollow drive shafts are made by using seamless steel tubes as hollow shaft blanks, it is important to prevent any cracking attributable to a reducing process and/or spinning process for tube ends. Furthermore, it is required to harden through the whole thickness from the outside surface to the inside surface and secure high toughness by means of heat treatment subsequent to cold working, and also required to secure sufficient torsion fatigue strengths to allow a longer service life for the final product.

In other words, when seamless steel tubes are used as hollow shaft blanks for making hollow drive shafts, it becomes indispensable that excellent cold workability which allows to form complex shapes, excellent hardenability and sufficient toughness in association with heat treatment, and sufficient torsion fatigue strength are concurrently satisfied. However, in hollow drive shafts which have been proposed thus far, the metallurgical aspect of seamless steel tubes has been hardly focused and studied.

For instance, Japanese Patent Application Publication No. 06-341422 discloses drive shafts in which a balance weight is fixed to a steel tube used in a drive shaft so as to reduce a revolution-related run out amplitude, wherein Carbon Equivalent ($Ceq=C+Si/24+Mn/6+Cr/5+Mo/4+Ni/40+V/14$) is set forth for the steel tube for the drive shaft and for the balance weight as well, so that any fatigue failure developing from the portion to which the balance weight is welded can be suppressed.

Nonetheless, it is not possible to obtain seamless steel tubes having excellent cold workability as well as excellent fatigue characteristics by simply stipulating Carbon Equivalent (Ceq) for the steel tube for the drive shaft and for the balance weight. By reason of this, it is difficult for the automobile propeller shaft disclosed in the Japanese Patent Application Publication No. 06-341422 to be applied as an one-piece type hollow drive shaft.

Next, in the Japanese Patent Application Publication No. 07-018330, there is disclosed a method for manufacturing high strength and toughness steel tubes suitable for the high strength member used in skirt members of automobiles. In the disclosed method, detail chemical compositions are stipulated while Ti is not contained and N is not specified at all, whereby even if B may be added, the steel composition is not configured to sufficiently impart harden ability. Further, the steel compositional design is not made in consideration of cold workability and fatigue characteristics, so that the manufacturing method disclosed in the Japanese Patent Application Publication No. 07-018330 is unlikely applied to produce seamless steel tubes as starting materials suitable for one-piece type hollow drive shafts.

Further, in the Japanese Patent Application Publication No. 07-088537, there is disclosed a method for manufacturing one-piece type hollow drive shifts wherein steel tubes with irregular inside diameters are made from tube blanks by cold drawing for wall thinning in which the plug outside diameter and die inside diameter are stipulated. However, the material grade disclosed in EXAMPLES is carbon steel corresponding to S48C specified in JIS Standard, and it seems that there is no intention to stipulate specific chemical compositions for purpose of improving cold workability, hardenability and fatigue characteristics.

And further, in the Japanese Patent Application Publication No. 08-073938, there is disclosed a method for producing high strength and toughness steel tubes, comprising the steps of: applying cold working by 10-70% in cross-section area reduction rate after hot tube making process; annealing; and heat-treating in combination of induction hardening and subsequent tempering. In the manufacturing method disclosed by the Japanese Patent Application Publication No. 08-073938, detail chemical compositions of steel stocks to be used are stipulated, but similarly to the manufacturing method described in the Japanese Patent Application Publication No. 07-018330, even if B and/or Ti may be added, the steel composition is not configured too sufficiently impart hardenability and further, the steel compositional design is not made in consideration of cold workability and fatigue characteristics, so that it is unlikely applied to produce tube blanks suitable for one-piece type hollow drive shafts.

Meanwhile, in the Japanese Patent Application Publication No. 2000-204432, there are disclosed drive shafts wherein induction hardening is applied to graphite steel so as not only to harden the surface layer but also to form a dual phase structure composed of ferrite and martensite in the core area. However, chemical composition disclosed in the Japanese Patent Application Publication No. 2000-204432 is suitable for hollow drive shafts made by means of friction welding and the heat treatment accompanying longer duration is required in order to obtain graphitized steel. In addition, since Cr is not contained in the chemical compositions, hardenability as well as fatigue strengths are not sufficient, whereby this is not; pertinent to steel tubes suitable for one-piece type hollow drive shafts.

And the Japanese Patent Application Publication No. 2001-355047 teaches high carbon steel tubes having excellent cold workability and induction hardenability as tube blanks for drive shafts, wherein the grain size of cementite is controlled to be not more than 1 μm. However, in this high carbon steel tubes by the Japanese Patent Application Publication No. 2001-355047, warm working is required to obtain the targeted microstructure to thereby increase production costs, and what is more, the disclosed chemical compositions are not pertinent to one-piece type hollow drive shafts which should concurrently satisfy cold workability, hardenability and fatigue characteristic.

SUMMARY OF THE INVENTION

As afore-mentioned, in the case that seamless steel tubes are used as hollow shift blanks for hollow drive shafts, it is required not only to prevent any cracking attributable to a reducing and/or spinning process of tube ends, but also to harden through the whole thickness from the outside surface to the inside surface by the heat treatment after cold working and to secure high toughness as well. And further, in order to achieve longer service life as the hollow drive shaft, it becomes necessary to secure cold workability, hardenability, toughness and torsion fatigue strength concurrently Incidentally, in the seamless steel tubes proposed by the prior art, there has been almost no study from the metallurgical aspect to specify the chemical compositions in order for the hollow shaft blanks to exhibit excellent cold workability, hardenability, toughness and torsion fatigue characteristic.

In other words, although it is not difficult for any of these features required for hollow drive shafts to be improved individually, it has been perceived based on the knowledge to date that all of them cannot be improved concurrently. For instance, as it is effective to increase the strength of the steel in order to secure high fatigue strength, the steel tubes to be used as starting materials can be made to have high strength, which instead attributes to reduce the cold workability.

The present invention is attempted in view of foregoing problems, and the object thereof pertains to provide seamless steel tubes having excellent cold workability, hardenability, toughness and torsion fatigue strength which are suitable for hollow shaft blanks to be used for one-piece type hollow drive shaft and a method for producing the same by looking into the metallurgical aspect with respect to specific characteristics to be imparted on the hollow drive shafts and by specifying chemical composition.

The present inventors made various investigations about the effects of alloy elements on the cold workability, hardenability, toughness and torsion fatigue strength in order to solve above problems. Eventually, it turns out that Si and Cr have great effects on the cold workability.

FIG. 1 is a diagram showing the effects of Si on the cold workability (cold forging). In this case, as a base steel for make-up, the steel with 0.35% C-13% Mn-0.17% Cr-0.015% Ti-0.001% B is selected and a Si content is varied accordingly, whereas the relationship between hardness (HRB) and a critical (compression rate (%) free of cracking in the compression test, specimen comprising 14 mill in outside diameter and 21 mill in length is delineated.

FIG. 2 is a diagram showing the effects of Cr on the cold workability (cold forging). In this case, as a base steel for make-up, the steel with 0.35% C-0.2% Si-1.3% Mn-0.015% Ti-0.001% B is selected and a Cr content is varied accordingly, whereas the relationship between hardness (HRB) and a critical compression rate (%) free of cracking in the compression test specimen comprising 14 mm in outside diameter and 21 mm in length is delineated.

As shown in FIG. 1, it; turns out that as the Si content decreases, the critical compression rate (%) free of cracking is markedly improved. Also, as shown in FIG. 2, it is found that the increase of Cr content can somewhat; improve the cold workability. In contrast, other elements prove to slightly deteriorate or have no effect on the cold workability.

On the other hand, when the Si content is reduced in order to enhance the cold workability, the hardenability is deteriorated to thereby make it unable to secure the strength at the inside surface of the steel tube after heat treatment. In this regard, it is deemed necessary to investigate on the recovery of the hardenability affected by the decrease of the Si content to obtain the improvement of the cold workability.

FIG. 3 is a diagram showing the effects of B and Cr on hardenability. The test specimens are prepared in such a manner that as a base steel for make-up, the steel with 0.35% C-0.05% Si-1.3% Mn-0.015% Ti-0.004% N is selected and a B—Cr content is varied accordingly, and Jominy end quench test is conducted. An example illustrating the distance from the quenched end and the hardness distribution is seen in the diagram, wherein the distance of the particular position—the slope of the hardness decrease abruptly changes—from the quenched end is defined as the hardening depth. As shown in FIG. 3, by increasing the content of B and/or Cr, the hardenability can be improved.

FIG. 4 is a diagram showing the effects of B, N and Ti on hardenability. As a base steel for make-up, the steel with (0.35-0.40)% C-(0.05-0.3)% Si-(1.0-1.5)% Mn-(0.1-0.5)% Cr is selected and each content of B, N and Ti is varied accordingly, while similarly to said FIG. 3, Jominy end quench test is conducted to measure the hardening depth.

At this occasion, in order to assess the effects of the content balance among B, N and Ti on the hardening depth of the test specimen, Beff which is defined by (a) or (b) equation as below is utilized:

$$\text{when } Neff = N - 14 \times Ti/47.9 \geqq 0,\ Beff = B - 10.8 \times (N - 14 \times Ti/47.9)/14 \quad (a)$$

$$\text{when } Neff = N - 14 \times Ti/47.9 < 0,\ Beff = B. \quad (b)$$

From the relationship between Beff and the hardening depth shown in FIG. 4, it becomes evident that in securing the harden ability of the steel, the content balance of B, Ti and N constitutes key factors, where without satisfying the condition: Beff≧0.0001, an adequate hardenability cannot be obtained.

FIG. 5 is a diagram showing the effects of Cr on fatigue strength and fatigue ratio. As a base steel for make-up, the steel with 0.35% C-0.2% Si-1.3% Mn-0.015% Ti-0.001% B is selected and a Cr content is varied accordingly, while Ono-type rotating bend test is conducted to measure fatigue strength and fatigue ratio. Here, the fatigue ratio is designated by (Fatigue strength/Tensile strength).

As shown in FIG. 5, when the Cr content increases, the fatigue ratio almost equally increases corresponding to the increase of the fatigue strength, thus making it possible to increase the fatigue strength without heightening the tensile strength. From this point, it should be recognized that enhancing the fatigue strength by increasing the Cr content will give least effects on the cold workability and toughness.

It has been well known that to enhance the fatigue strength, the tensile strength must be increased, and the action that the C content is increased to enhance the fatigue strength has been taken, which rather raised an issue such that the increase of C content deteriorated the cold workability and toughness. Despite this, from the findings shown in said FIG. 5, it is noted that since increasing the Cr content should enhance the fatigue strength, the fatigue strength can be secured without increasing the C content while suppressing the deterioration of the cold workability and toughness.

Further, it is made clear that a S content has great effects on cracking during cold working as well as on the torsion fatigue strength of drive shafts after forming. Especially, in the case that cold working is applied to seamless steel tubes, the grain deforms in a pancake like form wherein the face on which the pancakes are stacked in layers coincides with the cracking direction in a spinning process or with the propagation direction of fatigue crack in a torsion fatigue test. Further, an elongated MnS becomes an initiation to facilitate the generation and development of cracking in the spinning process and/or cracking in the torsion fatigue lest. In this regard, as the hollow shaft blanks, it reveals that seamless steel tubes are required to have MnS sufficiently lowered.

FIG. 6 is a diagram showing the effects of a S content on a critical flattening height rate (%) which is defined to generate cracking in a flattening and bend test. Test samples are prepared in such a manner that: the seamless steel tubes of 31 mm in outside diameter where S content is varied to various levels are used; cold drawing is applied thereto to obtain 27.5 mm in outside diameter; and the inside and outside surface are ground to be 25 mm in outside diameter and 5.7 mm in thickness. Further, a swaging process is applied to reduce to 18.2 mm in outside diameter, and then, each set of three (3) test specimens is prepared by grinding the inside and outside surface down to 17.5 mm in outside diameter and 4.8 mm in thickness. These test specimens are subjected to a flattening test whereas the flattening height rate to cause cracking is defined as the critical flattening height rate (%). Here, the case where no cracking is generated until when the opposing inner surface closely contact with each other is defined as 100% in the critical flattening height ratio.

As shown in FIG. 6, in the case that the S content comes to be not more than 0.005%, no cracking is observed in each of three tests where the test is conducted until the opposing inner surface closely contact with each other, whereby it proves that the critical flattening height rate (%) is greatly improved to withstand the severe swaging or spinning process.

FIG. 7 is a diagram showing the effects of a S content on torsion fatigue strength of steel tubes after heat; treatment. The seamless steel tubes which are subjected to the tempering treatment at 150° C. after quenching by means of induction heating, are used. The test specimen measuring 20 mm in outside diameter and 5 mm in thickness is used and the applied torque is varied to plot the maximum torque (N·m) without causing fatigue failure up until 1000000 cycles.

As shown in FIG. 7, similarly to the flattening test, in the case that the S content comes to be not more than 0.005%, the maximum torque (N·m) is remarkably improved, whereby the excellent torsion fatigue strength for the drive shaft proves to be imparted.

Specifying chemical compositions of seamless steel tubes based on the technical findings shown in foregoing FIGS. 1 to 7 makes it possible to secure excellent cold workability, hardenability, toughness and torsion fatigue strength and obtain suitable seamless steel tubes as hollow shaft blanks for making one-piece type hollow drive shafts.

Meanwhile, depending on the target shape of the drive shaft, processing itself should become much severer, and there is a case that any cracking likely occurs during processing in a one-piece form or during the spinning of splines. Consequently, much better cold workability should be demanded. To respond to this kind of demand, adopting the following process as the method for producing seamless steel tubes makes it possible to impart much more excellent cold workability.

To be concrete, after the hot tube making process for seamless steel tubes, cold working such as cold drawing by not less than 5% in cross-section area reduction rate is applied so as to adjust the dimensional accuracy. But in the case that the adequate cold workability for the drive shaft cannot be secured as cold-worked, heat treatment can be applied to improve the cold workability.

As the foregoing heat treatment, after cold working such as cold drawing for adjusting the dimensional accuracy, either annealing or normalizing can be adopted. As for other heat; treatment, spheroidizing annealing prior to or after cold working can be applied. By applying the heat treatment as mentioned above, the cold workability can be greatly improved to make the seamless steel tubes withstand a severe forming operation, thereby enabling the forming operation into the drive shafts having high torsion stiffness and conducive to excellent indoor quietness.

The present invention is accomplished based on the above findings and the gist thereof pertains to seamless steel tubes in (1)-(4) and a method for producing the same in (5) as described in the following.

(1) A seamless steel tube whose chemical composition comprises, in mass %, C: 0.30 to 0.50%, Si: not more than 0.5%, Mn: 0.3 to 2.0%, P: not more than 0.025%, S: not more than 0.005%, Cr: 0.15 to 1.0%, Al: 0.001 to 0.05%, Ti: 0.005 to 0.05%, N: not more than 0.02%, B: 0.0005 to 0.01% and O (oxygen): not more than 0.0050%, the balance being Fe and impurities, wherein Beff defined in the equation (a) or (b) as below is not less than 0.0001;

when $Neff = N - 14 \times Ti/47.9 \geqq 0$ where each of Ti, N and B designates its content %, $$Beff = B - 10.8 \times (N - 14 \times Ti/47.9)/14 \quad (a)$$

likewise, when $Neff = N - 14 \times Ti/47.9 < 0$, $Beff = B$. (b)

(2) A seamless steel tube according to foregoing (1), further comprising, in mass %, one or more of Cu: 0.05 to 1%, Ni: 0.05 to 1% and Mo: 0.05 to 0.1%.

(3) A seamless steel tube according to foregoing (1) or (2), further comprising in mass %, one or more of V: 0.005 to 0.1%, Nb: 0.005 to 0.1% and Zr: 0.005 to 0.1%.

(4) A seamless steel tube according to any of foregoing (1) to (3), further comprising, in mass %, one or more of Ca: 0.0005 to 0.01%, Mg: 0.0005 to 0.01% and REM: 0.0005 to 0.01%.

(5) A method for producing seamless steel tubes in which cold working of not less than 5% in cross-sectional area reduction rate is applied to a steel tube, said steel tube being made by a tube making process using material with the chemical composition described in any of foregoing (1) to (4), wherein annealing or normalizing is applied after said cold working, or alternatively spheroidizing annealing is applied prior to or after said cold working.

BEST MODE FOR CARRYING OUT THE INVENTION

Reasons why the seamless steel tubes pertinent to the present invention are stipulated as above are recited while categorizing into chemical compositions and the production method. The chemical compositions are shown by mass % in the followings.

1. Chemical Compositions

C: 0.30 to 0.50%

C is an effective element for increasing strength and enhancing fatigue strength, but has an adverse effect such as deteriorating cold workability and toughness. When the C content, is below 0.30%, a sufficient, fatigue life cannot be achieved. On the other hand, when it exceeds 0.50%, the cold workability and toughness notably deteriorate. Thus, the C content is set in the range of 0.30 to 0.50%.

Further, in order to secure fatigue strength, cold workability and toughness which are well-balanced with each other, the C content preferably is set in the range of 0.33 to 0.47%, and more preferably set in the range of 0.37 to 0.42%.

Si: not More than 0.5%

Figure 1:
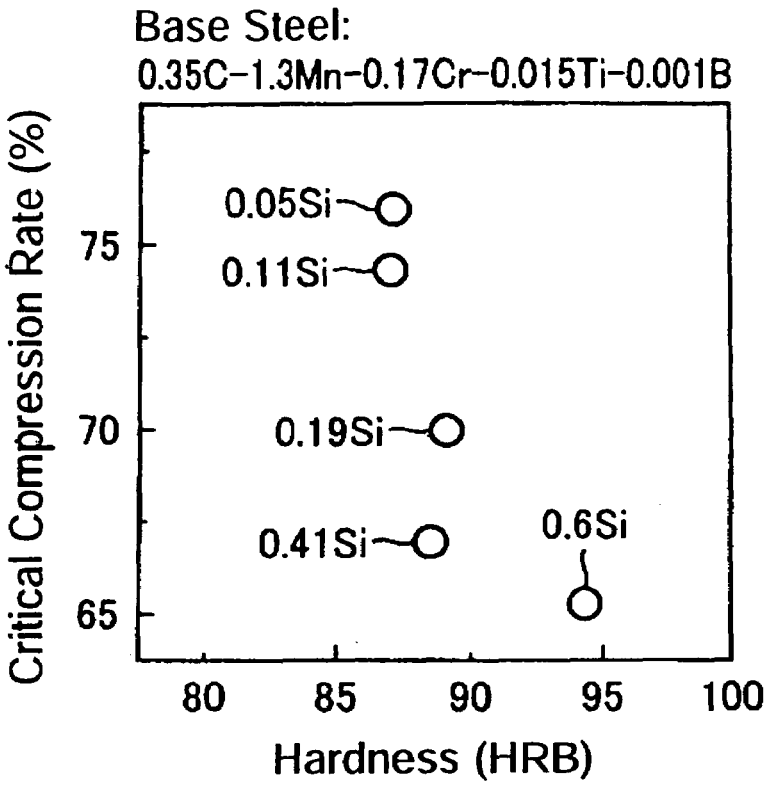
FIG. 1 is a diagram showing the effects of Si on the cold workability (cold forging).

Si is an element serving as a deoxidizer. Since the cold workability cannot be secured when the Si content becomes more than 0.5%, it is set to be not more than 0.5%. As shown in foregoing FIG. 1, the less the Si content is, the better the cold workability gets. And depending on the shape of the drive shaft, the required cold workability varies and severe cold working happens to be applied.

Therefore, in order to respond to the need of much severer cold working, the Si content can be specified in stages such that it, is preferably set to be not more than 0.3%, more preferably set to be not more than 0.22%, most preferably set to be not more than 0.15%, and further set to be not more than 0.1%, whereas further possible lower content is sought according to the demand.

Mn: 0.3 to 2.0%

Mn is an effective element; for securing hardenability in heat treatment after a forming step. In order to make most of its function to harden through the whole thickness from the outside surface to the inside surface, Mn shall be contained by not less than 0.3%. On the other hand, when the Mn content exceeds 2.0%, the cold workability deteriorates. Hence, the Mn content is set in the range of 0.3 to 2.0%. Further, in order to secure the hardenability and cold workability, well-balanced with each others the Mn content is preferably set in the range of 1.1 to 1.7%, and more preferably set in the range of 1.2 to 1.4%.

P: not More than 0.025%

P is included as an impurity in steel, which likely concentrates in the vicinity of final solidification zone during solidification and segregates along the grain boundaries to deteriorate hot workability, toughness and fatigue strength. In this regard, its content is preferably reduced as low as possible. But containing it by 0.025% is not harmful and allowed, so that the P content is set to be not more than 0.025%. Further, in order to maintain the toughness and fatigue strength at the higher level, the P content is preferably set to be not more than 0.019%, and more preferably set to be not more than 0.009%.

S: not More than 0.005%

Figure 6:
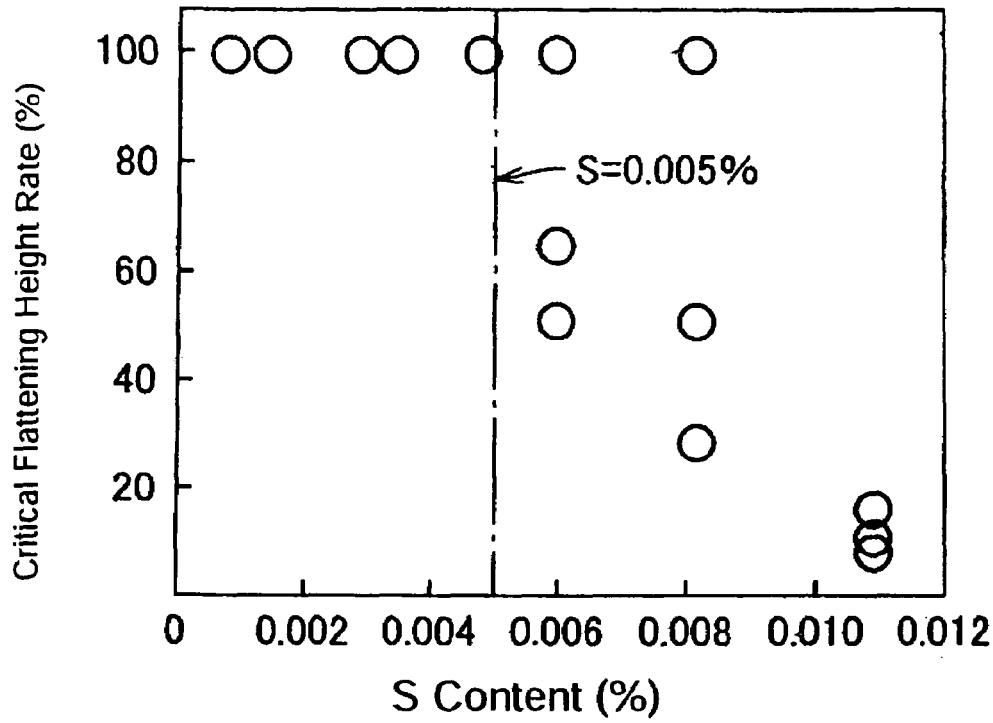
FIG. 6 is a diagram showing the effect-s of a S content on a critical flattening height rate (%) which is defined to generate cracking in a flattening and bend test.
Figure 7:
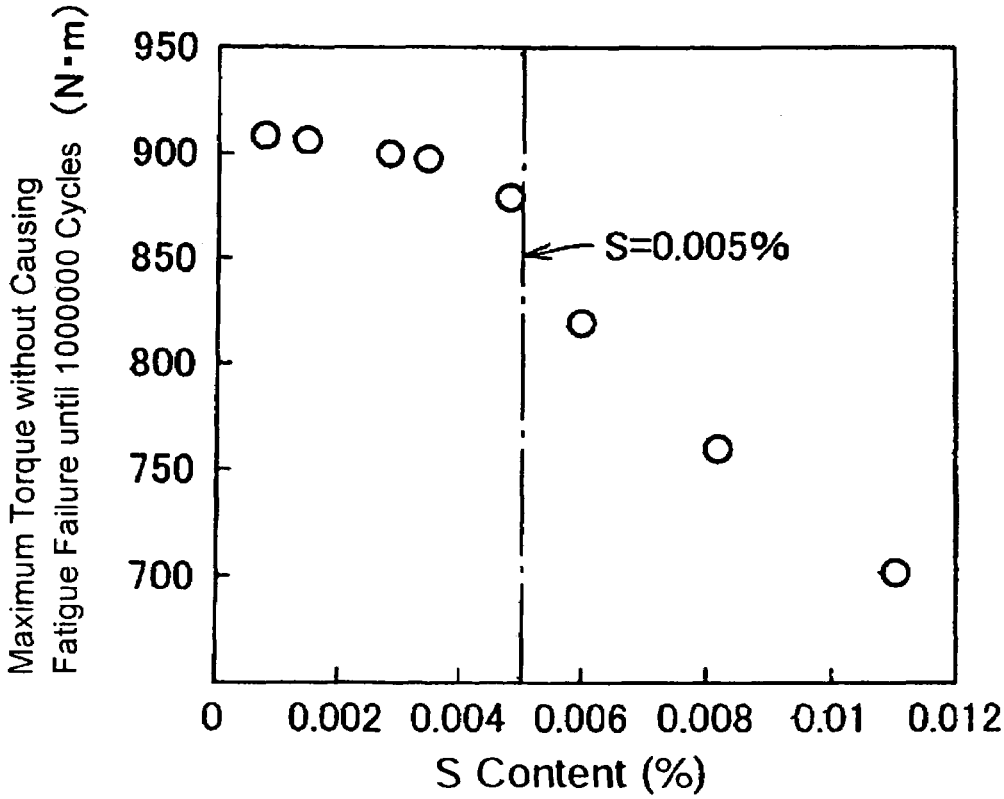
FIG. 7 is a diagram showing the effects of a S content on torsion fatigue strength of steel tubes after heat treatment.

S is included as all impurity in steel, and likely segregates along the grain boundaries during solidification, whereby hot workability and toughness are deteriorated, and further cold workability and torsion fatigue strength in particular are deteriorated when seamless steel tubes are adopted as hollow shaft blanks as shown in foregoing FIGS. 6 and 7. In this regard, in order to secure the cold workability required for seamless steel tubes for use in hollow shafts blanks to make drive shafts and to secure torsion fatigue strength after heat treatment, the S content needs to be not more than 0.005%.

In the case that it becomes necessary to secure the cold workability and torsion fatigue strength further more, it; is preferable to reduce the S content to be not more than 0.003%, more preferable to reduce it to be not more than 0.002%, and most preferable to reduce it to be not more than 0.001%.

Cr: 0.15 to 1.0%

Figure 2:
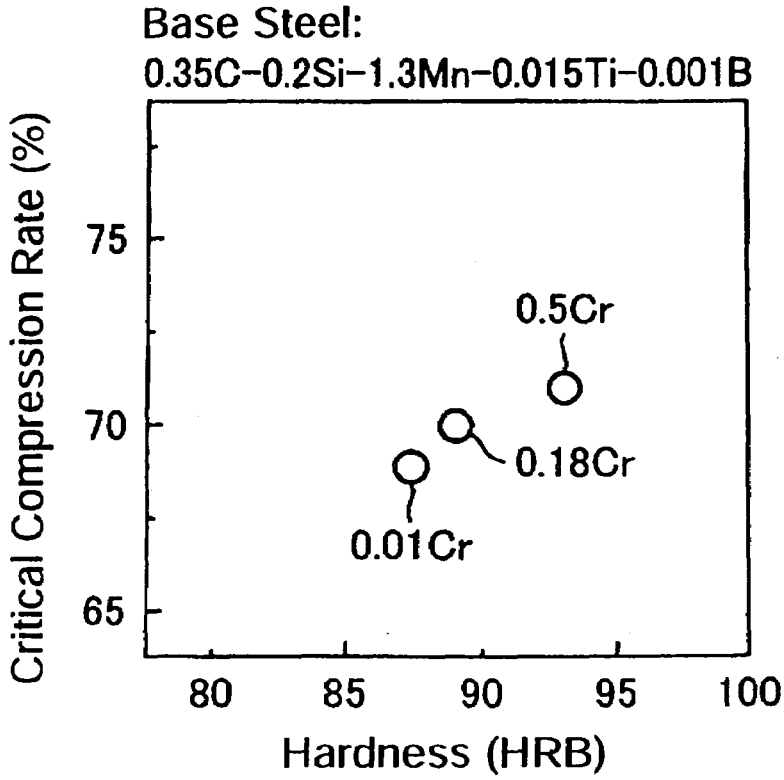
FIG. 2 is a diagram showing the effects of Cr on the cold workability (cold forging).
Figure 3:
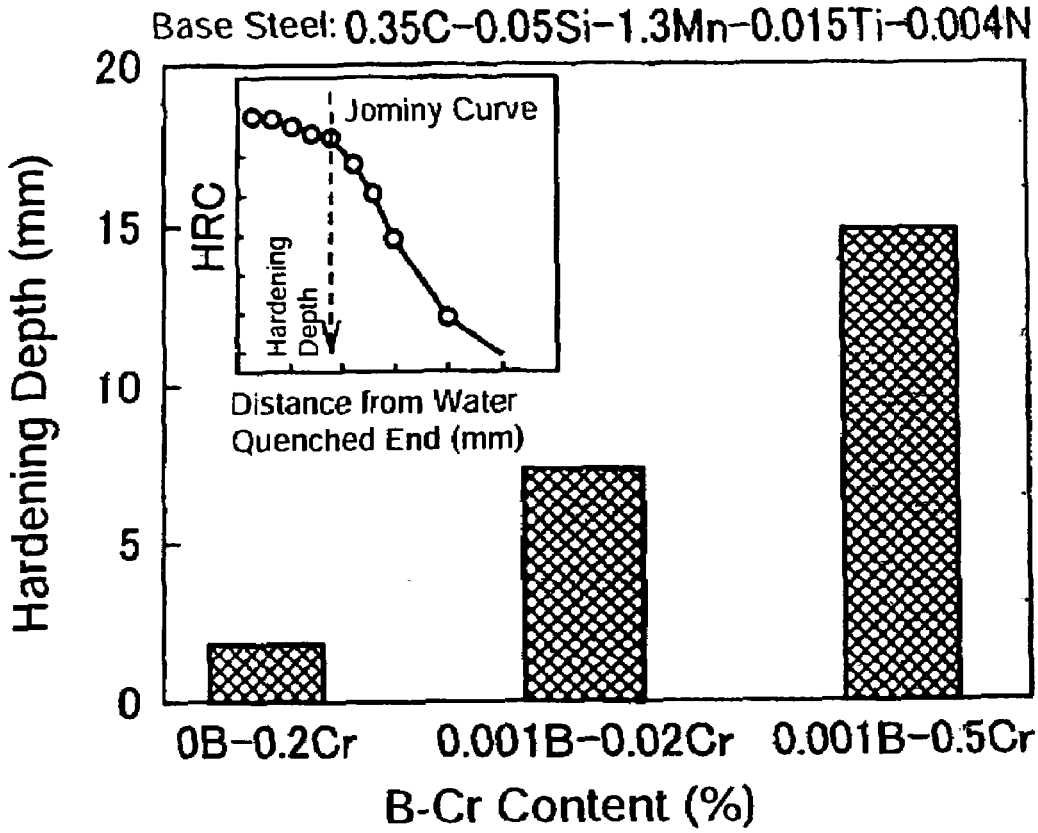
FIG. 3 is a diagram showing the effects of B and Cr on harden ability.
Figure 5:
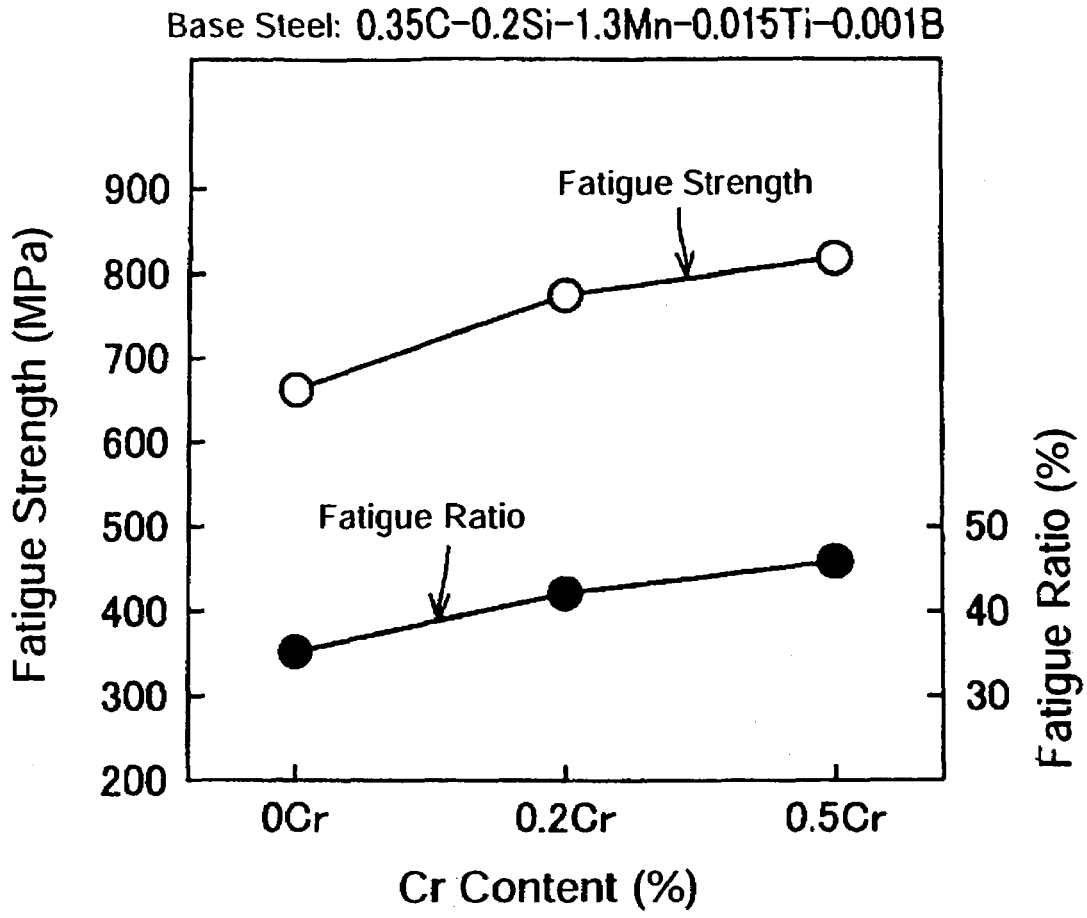
FIG. 5 is P diagram showing the effects of Cr on fatigue strength and fatigue ratio.

Cr is an effective element for increasing fatigue strength without deteriorating cold workability too much as shown in foregoing FIGS. 2 and 5, and effective to enhance hardenability similarly to B as shown in foregoing FIG. 3. Therefore, Cr shall be contained by not less than 0.15% in order to secure predetermined fatigue strength. On the other hand, when the Cr content exceeds 1.0%, the decrease of cold workability becomes notable. Hence, the Cr content is set in the range of 0.15 to 1.0%.

Further, in order to secure fatigue strength, cold workability and hardenability, well-balanced with each other, the Cr content is preferably set in the range of 0.2 to 0.8%, and more preferably set in the range of 0.3 to 0.6%. It is much more preferable that the Cr content is set in the range of 0.4 to 0.6%.

Al: 0.001 to 0.05%

Al is an element serving as a deoxidizer. In order to utilize its function as a deoxidizer, its content should be set to be not less than 0.001%, but when the content exceeds 0.05%, alumina-type non-metallic inclusions increase, thereby likely causing fatigue strength to deteriorate and likely generating numerous surface defects as well. In this regard, the Al content, is set in the range of 0.001 to 0.05%. Further, in order to secure better surface quality, the Al content is preferably set in the range of 0.001 to 0.03%. Furthermore, setting the Al content; in the range of 0.001 to 0.015% can improve the surface conditions further, which is more preferable.

To secure hardenability, not only each content of Ti, N and B in the followings is stipulated, but also the conditional equation specifying the balance of each content must be satisfied.

Ti: 0.005 to 0.05%

Ti serves for combining and immobilizing N to form TiN. But when its content is below 0.005%, the function to immobilize N cannot be fully put into effect, while the Ti content exceeding 0.05% should deteriorate cold workability and toughness in steel. In this regard, the Ti content is set in the range of 0.005 to 0.05%.

N: not More than 0.01%

N is an element to reduce toughness, which likely combines B in steel. When the N content exceeds 0.02%, cold workability and toughness notably deteriorate, so that its content is set to be not more than 0.02%. In view of enhancing cold workability and toughness, the content, is preferably set to be not more than 0.01%, and more preferably set to be not more than 0.007%.

B: 0.0005 to 0.01%

B is an element for enhancing hardenability. When its content is below 0.0005%, hardenability becomes short, while containing it by more than 0.01% deteriorates cold workability and toughness. In this regard, the B content is set in the range of 0.0005 to 0.01%.

Figure 4:
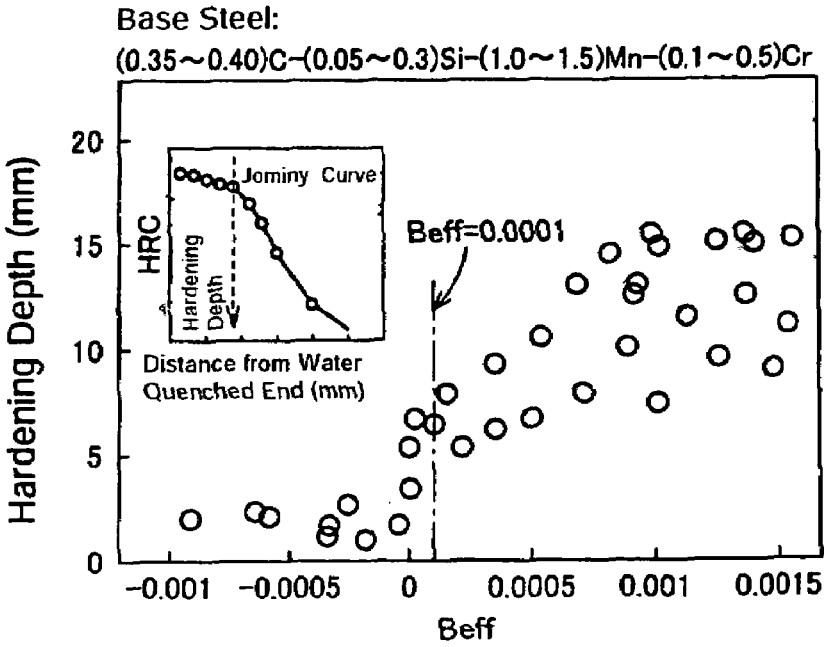
FIG. 4 is a diagram showing the effects of B, N and Ti on hardenability.

Further, as shown in foregoing FIG. 4, based on the premise that B enhances hardenability, Beff expressed by the equation (a) or (b) as below shall meet the condition of being not less than 0.0001;

$$\text{namely, where } Neff = N - 14 \times Ti/47.9 \geqq 0 \; Beff = B - 10.8 \times (N - 14 \times Ti/47.9)/14 \quad (a)$$

$$\text{similarly, where } Neff = N - 14 \times Ti/47.9 < 0, \; Beff = B. \quad (b)$$

In order to put; the function possessed by B of enhancing hardenability into effect, the effect of N in steel must be diminished. B is likely to combine with N, so that free N being present in steel should be combined with B to form BN to thereby harm the function possessed by B of enhancing hardenability. In this regard, Ti is added according t-o the N content to immobilize it as TiN, whereby B can stay in steel t-o effectively serve for enhancing hardenability. By reason of this, Beff as above shall meet the condition of being not; less than 0.0001.

Incidentally, as Beff becomes larger, the hardenability is enhanced much more. Thus, it is preferable that Beff meets the condition of being not less than 0.0005, and more preferable that Beff meets the condition of being not less than 0.001.

O (Oxygen): not More than 0.0050%

O is an impurity to reduce toughness and fatigue strength. Since toughness and fatigue strengths deteriorates notably when the O content exceeds 0.0050%, its content is set to be not more than 0.0050%.

Although following elements need not be added necessarily, by containing one or more of those elements where appropriate, cold workability, hardenability, toughness and torsion fatigue strength can be further enhanced.

Cu: 0.05 to 1%, Ni: 0.05 to 1%, and Mo: 0.05 to 1%

Any of Cu, Ni or Mo is an effective element for enhancing hardenability to increase strengths in steel to thereby improve fatigue strengths in steel. To put its function into effect, one or more of those can be added. The effect will become evident when the content of any of Cu, Ni or Mo is not less than 0.05%. However, when its content exceeds 1%, the cold workability deteriorates notably. In this regard, when added, the content of any of Ni, Mo or Cu shall be in the range of 0.05 to 1%.

V: 0.005 to 0.1%, Nb: 0.005 to 0.1% and Zr: 0.005 to 0.1%

Any of V, Nb or Zr is an effective element for forming carbide, suppressing the coarsening of grain sizes during heating in heat treatment to thereby enhance toughness. Hence, in the case that the toughness in steel should be enhanced, one or more of those can be added. The effect will become evident when the content of any one of V, Nb or Zr is not less than 0.005%. However, when its content exceeds 0.1%, the coarse precipitates are formed to rather deteriorate the toughness. In this regard, when added, the content of any of V, Nb or Zr shall be in the range of 0.005 to 0.1%.

Ca: 0.0005 to 0.01%, Mg: 0.0005 to 0.01% and Rare-Earth Metal (REM): 0.0005 to 0.01%

Any of Ca, Mg or REM is an element for contributing to enhance cold workability as well as torsion fatigue strength. To put its function into effect, one or more of those can be added. The effect; will become evident when the content of any of Ca, Mg or REM is not less than 0.0005%. However, when its content exceeds 0.01%, the coarse non-metallic inclusions are formed to rather reduce the fatigue strength. In this regard, when added, the content of any of Ca, Mg or REM shall be in the range of 0.0005 to 0.01%.

2. Production Method

In the present invention, in order to obtain seamless steel tubes having excellent; cold workability, hardenability, toughness and torsion fatigue strength) by adopting the steel with chemical compositions specified by the present invention as the starting material, a production method in the following can be employed.

Namely, seamless steel tubes according to the present invention can be produced by a method comprising the steps of: refining steel with chemical compositions as above by a converter or, in the alternative, melting the same by an electric furnace or vacuum melting furnace; solidifying by either a continuous casting process or an ingot; making process; making steel blanks (billets) by either using cast steels as they are or blooming the cast steels or ingots; and applying a conventional seamless steel tube making process, followed by being cooled in open air subsequently.

It is generally perceived that seamless steel tubes obtained through the seamless steel tube making process can be employed as hollow shaft blanks for making hollow drive shafts. But the method for producing seamless steel tubes according to the present invention further entails cold working by not less than 5% in cross-sectional area reduction rate to enhance dimensional accuracy, followed by either annealing or normalizing, where both comprise heating at 500 to 1100° C. and subsequently cooling in open air, or, in the alternative, entails spheroidizing annealing before or after said cold working. These heat treatments enable cold workability of seamless steel tubes to be enhanced and make it possible to secure features suitable for hollow shaft blanks to be employed for making hollow drive shafts.

In the method for producing seamless steel tubes according to the present invention, the cold working by not less than 5% in cross-sectional area reduction rate makes it possible to obtain steel tubes having excellent surface quality to reduce initiation sites of fatigue failure to thereby enhance fatigue strength.

Further, the heating temperatures for either annealing or normalizing after cold working are set, in the range of 500 to 1100° C. When the heating temperatures are below 500° C., any strain at the time of the cold working should be detained to aggravate the cold workability. On the other hand, when the heating temperatures exceed 1100° C., crystal grains are coarsened to thereby reduce toughness.

The condition of spheroidizing annealing is not specified in particular, but for example, can be represented by the heat treatment in which a process comprising heating in the range of at 720 to 850° C. and subsequent slow cooling with the rate of not more than 50° C./hr down to the temperatures in the range of 650 to 670° C. is singly applied, or alternatively said process is applied twice or more. The slower the cooling rate is, the more the carbides are spheroidized, so that the cooling rate is preferable to be set to not more than 40° C./hr, and more preferable to be set to not more than 30° C./hr. The spheroidizing annealing causes cementite in pearlite structure to disintegrate in a discrete manner to thereby spheroidize, whereby the cold workability can be further enhanced.

EXAMPLES

Effects on hollow shaft blanks as the starting materials for making hollow drive shafts which can be obtained by seamless steel lubes according to the present invention are recited based on detail Examples.

Example 1

A vacuum melting process is applied to prepare various steel grades designated by Steel Nos. 1 through 32 (Steel Nos. 1 through 21: Inventive, Steel Nos. 22 through 32: Comparative) with chemical compositions shown in Tables 1 and 2, which are rolled into steel blanks (billets) to be subjected to the tube making process obtaining steel tubes of 50.8 mm in outside diameter and 7.9 mm in wall thickness.

TABLE 1

Table 1

| Steel | Chemical Composition (mass %, Balance: Fe and Impurities) | | | | | | | | | | | | | | Conditional Equation | |
|---|---|---|---|---|---|---|---|---|---|---|---|---|---|---|---|---|
| No | C | Si | Mn | P | S | Cr | Al | Ti | N | B | O | Cu, Mo, Ni | V, Nb, Zr | Ca, Mg, REM | Neff | Beff |
| 1 | 0.33 | 0.07 | 1.62 | 0.017 | 0.0019 | 0.49 | 0.022 | 0.019 | 0.0011 | 0.0008 | 0.0020 | | | | −0.0034 | 0.0008 |
| 2 | 0.36 | 0.07 | 1.66 | 0.004 | 0.0002 | 0.52 | 0.019 | 0.016 | 0.0051 | 0.0010 | 0.0010 | | | | 0.0003 | 0.0007 |
| 3 | 0.37 | 0.06 | 1.71 | 0.011 | 0.0008 | 0.49 | 0.022 | 0.015 | 0.0045 | 0.0007 | 0.0008 | | | | 0.0001 | 0.0006 |
| 4 | 0.38 | 0.04 | 1.36 | 0.002 | 0.0012 | 0.31 | 0.020 | 0.017 | 0.0034 | 0.0007 | 0.0008 | | | | −0.0012 | 0.0007 |
| 5 | 0.33 | 0.07 | 1.32 | 0.004 | 0.0009 | 0.59 | 0.013 | 0.023 | 0.0057 | 0.0007 | 0.0020 | | | | −0.0008 | 0.0007 |
| 6 | 0.36 | 0.31 | 1.65 | 0.002 | 0.0040 | 0.41 | 0.023 | 0.025 | 0.0021 | 0.0009 | 0.0015 | | | | −0.0040 | 0.0009 |
| 7 | 0.34 | 0.03 | 1.69 | 0.006 | 0.0025 | 0.25 | 0.012 | 0.024 | 0.0068 | 0.0006 | 0.0010 | Cu: 0.15 | | | −0.0002 | 0.0006 |
| 8 | 0.34 | 0.07 | 1.25 | 0.009 | 0.0009 | 0.26 | 0.021 | 0.017 | 0.0055 | 0.0007 | 0.0020 | Mo: 0.1 Ni: 0.3 | | | 0.0004 | 0.0003 |
| 9 | 0.37 | 0.07 | 1.31 | 0.016 | 0.0026 | 0.59 | 0.010 | 0.017 | 0.002 | 0.0007 | 0.0014 | | V: 0.1 | | −0.0023 | 0.0007 |
| 10 | 0.36 | 0.06 | 1.66 | 0.003 | 0.0025 | 0.21 | 0.027 | 0.018 | 0.0058 | 0.0007 | 0.0009 | | Nb: 0.025 Zr: 0.022 | | 0.0004 | 0.0003 |
| 11 | 0.35 | 0.05 | 1.39 | 0.004 | 0.0013 | 0.35 | 0.010 | 0.021 | 0.0066 | 0.0011 | 0.0008 | | | Ca: 0.0011 | 0.0004 | 0.0007 |
| 12 | 0.35 | 0.03 | 1.29 | 0.012 | 0.0023 | 0.57 | 0.021 | 0.019 | 0.0063 | 0.0008 | 0.0019 | | | Mg: 0.0010 REM: 0.0015 | 0.0006 | 0.0003 |
| 13 | 0.37 | 0.07 | 1.48 | 0.011 | 0.0009 | 0.32 | 0.020 | 0.020 | 0.0066 | 0.0008 | 0.0021 | Cu: 0.2 Ni: 0.2 | Nb: 0.015 | | 0.0006 | 0.0002 |
| 14 | 0.36 | 0.06 | 1.60 | 0.004 | 0.0016 | 0.27 | 0.030 | 0.022 | 0.001 | 0.0012 | 0.0020 | Mo: 0.1 | V: 0.09 | | −0.0042 | 0.0012 |
| 15 | 0.33 | 0.07 | 1.71 | 0.008 | 0.0008 | 0.23 | 0.030 | 0.021 | 0.0042 | 0.0012 | 0.0016 | | Nb: 0.019 Zr: 0.008 | Ca: 0.0005 | −0.0015 | 0.0012 |
| 16 | 0.37 | 0.05 | 1.31 | 0.004 | 0.0010 | 0.44 | 0.023 | 0.017 | 0.0044 | 0.0007 | 0.0022 | | V: 0.15 | REM: 0.0013 | −0.0004 | 0.0007 |
| 17 | 0.36 | 0.06 | 1.71 | 0.011 | 0.0007 | 0.35 | 0.023 | 0.022 | 0.007 | 0.0011 | 0.0015 | Cu: 0.18 | | Mg: 0.0013 REM: 0.0010 | 0.0004 | 0.0007 |
| 18 | 0.34 | 0.06 | 1.61 | 0.010 | 0.0014 | 0.35 | 0.024 | 0.020 | 0.0061 | 0.0006 | 0.0017 | Ni: 0.15 | | Ca: 0.0020 | 0.0002 | 0.0004 |
| 19 | 0.33 | 0.07 | 1.39 | 0.015 | 0.0015 | 0.48 | 0.022 | 0.021 | 0.0045 | 0.0008 | 0.0013 | Ni: 0.34 | Nb: 0.007 | Mg: 0.0013 | −0.0013 | 0.0008 |
| 20 | 0.33 | 0.05 | 1.46 | 0.010 | 0.0026 | 0.52 | 0.023 | 0.022 | 0.007 | 0.0009 | 0.0013 | Mo: 0.09 Ni: 0.22 | Nb: 0.012 Zr: 0.031 | Ca: 0.0007 REM: 0.0007 | 0.0004 | 0.0005 |

TABLE 1-continued

Table 1

| Steel No | Chemical Composition (mass %, Balance: Fe and Impurities) C | Si | Mn | P | S | Cr | Al | Ti | N | B | O | Cu, Mo, Ni | V, Nb, Zr | Ca, Mg, REM | Conditional Equation Neff | Beff |
|---|---|---|---|---|---|---|---|---|---|---|---|---|---|---|---|---|
| 21 | 0.36 | 0.06 | 1.61 | 0.015 | 0.0005 | 0.21 | 0.015 | 0.019 | 0.0038 | 0.0012 | 0.0018 | Cu: 0.1 Mo: 0.08 | V: 0.13 Nb: 0.025 | Ca: 0.0009 | −0.0014 | 0.0012 |

TABLE 2

Table 2

| Steel No | Chemical Composition (mass %, Balance: Fe and Impurities) C | Si | Mn | P | S | Cr | Al | Ti | N | B | O | Cu, Mo, Ni | V, Nb, Zr | Ca, Mg, REM | Conditional Equation Neff | Beff |
|---|---|---|---|---|---|---|---|---|---|---|---|---|---|---|---|---|
| 22 | *0.27 | 0.06 | 1.66 | 0.016 | 0.0013 | 0.35 | 0.021 | 0.018 | 0.0055 | 0.0006 | 0.0015 | Ni: 0.15 | | | 0.0002 | 0.0005 |
| 23 | *0.51 | 0.07 | 1.71 | 0.008 | 0.0014 | 0.35 | 0.020 | 0.023 | 0.0063 | 0.0007 | 0.0019 | | | | −0.0003 | 0.0007 |
| 24 | 0.34 | *0.55 | 1.55 | 0.020 | 0.0013 | 0.27 | 0.022 | 0.023 | 0.0066 | 0.0005 | 0.0022 | Ni: 0.11 | | | −0.0001 | 0.0005 |
| 25 | 0.34 | 0.04 | *0.28 | 0.002 | 0.0010 | 0.36 | 0.013 | 0.018 | 0.0058 | 0.0011 | 0.0018 | | | Ca: 0.0007 | 0.0004 | 0.0007 |
| 26 | 0.34 | 0.07 | *2.53 | 0.010 | 0.0014 | 0.53 | 0.028 | 0.020 | 0.0068 | 0.0010 | 0.0009 | | V: 0.09 | | 0.0007 | 0.0002 |
| 27 | 0.35 | 0.07 | 1.64 | 0.017 | *0.0071 | 0.21 | 0.030 | 0.016 | 0.0033 | 0.0010 | 0.0010 | | | | −0.0011 | 0.0010 |
| 28 | 0.34 | 0.05 | 1.45 | 0.003 | 0.0029 | *0.05 | 0.017 | 0.015 | 0.0049 | 0.0011 | 0.0021 | Mo: 0.06 | Nb: 0.021 | Ca: 0.0014 | 0.0004 | 0.0007 |
| 29 | 0.34 | 0.04 | 1.71 | 0.010 | 0.0028 | *1.21 | 0.024 | 0.024 | 0.0051 | 0.0005 | 0.0015 | | | REM: 0.0007 | −0.0015 | 0.0005 |
| 30 | 0.33 | 0.04 | 1.54 | 0.016 | 0.0022 | 0.53 | 0.015 | *0.001 | 0.0056 | 0.0010 | 0.0021 | | Nb: 0.015 | Mg: 0.0009 | 0.0041 | −0.0031 |
| 31 | 0.33 | 0.06 | 1.32 | 0.001 | 0.0022 | 0.25 | 0.012 | 0.025 | *0.0218 | 0.0012 | 0.0010 | Ni: 0.13 | | Ca: 0.0013 | 0.0112 | −0.0100 |
| 32 | 0.35 | 0.05 | 1.54 | 0.015 | 0.0005 | 0.21 | 0.016 | 0.023 | 0.0047 | *— | 0.0015 | | | | −0.0016 | — |

Note:
The symbol * indicates that the content deviates from the range defined by the present invention.

The steel tubes thus obtained are subjected to the cold drawing process to the size of 40 mm in outside diameter and 7 mm in wall thickness, and further subjected to the swaying process to the size of 28 mm in outside diameter and 9 mm in wall thickness. The absence or presence of any cracking which may generate during the cold working is checked, whereas in Table 3 the demonstration run that no cracking develops is designated by the symbol ○ while the run that any cracking occurs is designated by the symbol x.

Also, to simulate the spline processing by the cold spinning process, a flattening press work by 40% in flattening rate is run and the absence or presence of any cracking which may generate during the press work is checked. In Table 3, the run where no cracking develops is designated by a symbol ○ while the run where any cracking occurs is designated by a symbol x.

After then, the starting materials of 28 mm in outside diameter and 9 mm in wall thickness which are obtained by the swaging process are subjected to an induction hardening process to investigate harden ability. Then, Vickers Hardness Tests both on the outside and inside surface are carried out, whereas when the difference of the hardness value(s) between the surfaces is not more than 50, the hardenability is designated by a symbol ○ while when the difference of the hardness value(s) between the surfaces is more than 50, indicating insufficient hardenability, the evaluation result of the hardenability is designated by a symbol x.

Next, the tempering treatment at 150° C. with 1 hour duration is applied to sample tubes which are subjected to the induction hardening process, and then, an absorbed energy in Charpy Impact Test in accordance with JIS Z 2202 and JIS Z 2242 is measured. Half size specimens (5 mm in width and 2-mm U-notch) are employed and tested at 20° C., where the absorbed energy (J) is measured at each test run. When the average of two measurements is not less than 10 J, an evaluation result of the test run is designated by a symbol ○, while when the average of two measurements is less than 10 J it is designated by a symbol x.

With regard to an evaluation of fatigue life, torsion fatigue tests with the variation of applied torque are conducted, being evaluated based on the maximum torque that does not cause any fatigue failure up until 1000000 cycles. The evaluation result of the test run where the maximum torque exceeds 2500 N·m is designated by a symbol ○, while the one where the maximum torque is below 2500 N·m is designated by a symbol x.

TABLE 3

Table 3

| Steel No. | Absence or Presence of Cracking during cold Working | Absence or Presesnce of Cracking during Spinning | Fatigue Life | Hardenability | Toughness | Remark |
|---|---|---|---|---|---|---|
| 1 | ○ | ○ | ○ | ○ | ○ | Inventive Example |
| 2 | ○ | ○ | ○ | ○ | ○ | Inventive Example |
| 3 | ○ | ○ | ○ | ○ | ○ | Inventive Example |
| 4 | ○ | ○ | ○ | ○ | ○ | Inventive Example |
| 5 | ○ | ○ | ○ | ○ | ○ | Inventive Example |
| 6 | ○ | ○ | ○ | ○ | ○ | Inventive Example |
| 7 | ○ | ○ | ○ | ○ | ○ | Inventive Example |
| 8 | ○ | ○ | ○ | ○ | ○ | Inventive Example |
| 9 | ○ | ○ | ○ | ○ | ○ | Inventive Example |
| 10 | ○ | ○ | ○ | ○ | ○ | Inventive Example |
| 11 | ○ | ○ | ○ | ○ | ○ | Inventive Example |
| 12 | ○ | ○ | ○ | ○ | ○ | Inventive Example |
| 13 | ○ | ○ | ○ | ○ | ○ | Inventive Example |
| 14 | ○ | ○ | ○ | ○ | ○ | Inventive Example |
| 15 | ○ | ○ | ○ | ○ | ○ | Inventive Example |
| 16 | ○ | ○ | ○ | ○ | ○ | Inventive Example |
| 17 | ○ | ○ | ○ | ○ | ○ | Inventive Example |
| 18 | ○ | ○ | ○ | ○ | ○ | Inventive Example |
| 19 | ○ | ○ | ○ | ○ | ○ | Inventive Example |
| 20 | ○ | ○ | ○ | ○ | ○ | Inventive Example |
| 21 | ○ | ○ | ○ | ○ | ○ | Inventive Example |
| 22 | ○ | ○ | X | X | ○ | Comparative Example |
| 23 | X | X | ○ | ○ | X | Comparative Example |
| 24 | X | X | ○ | ○ | ○ | Comparative Example |
| 25 | ○ | ○ | ○ | X | ○ | Comparative Example |
| 26 | X | X | ○ | ○ | X | Comparative Example |
| 27 | X | X | X | ○ | ○ | Comparative Example |
| 28 | ○ | X | X | X | ○ | Comparative Example |
| 29 | X | X | ○ | ○ | X | Comparative Example |
| 30 | X | X | X | X | ○ | Comparative Example |
| 31 | X | X | X | X | ○ | Comparative Example |
| 32 | ○ | ○ | ○ | X | ○ | Comparative Example |

As shown in Table 3, the steel grades designated by Steel Nos. 1 through 21 are Inventive Examples conforming with the specified conditions by the present invention, and reveal to have excellent fundamental features such as cold workability, hardenability, toughness and torsion fatigue strength.

On the other hand, the steel grades designated by Steel Nos. 22 through 32 are Comparative Examples deviating from the specified conditions by the present invention, so that any of those fundamental features could be insufficient to likely cause some kind of a problem, thus making it impossible to be used as the starting materials for making hollow drive shafts.

Example 2

Among the Inventive Examples shown foregoing Table 3, applying too much cold work rate may cause cracking, although no cracking should occur during the typical cold working or during the typical spinning process thanks to the imparted fundamental features. For instance, said Steel No. 1 shown in foregoing Table 3 does not; exhibit; any cracking when the cold work rate expressed by the cross-sectional area reduction rate is 60%, but likely exhibit cracking at 80% in the cold work rate.

In the case that too much reduction rate of cross-sectional area is applied in cold working, how normalizing or annealing at the intermediate stage of cold working acts or, in the alternative, spheroidizing annealing before or after the cold working acts is shown in Table 4. The absence or presence of cracking in Table 4 is indicated as follows: a symbol ○ denotes no cracking: a symbol x denotes the occurrence of cracking. And then, an evaluation by applying spinning to make a spline is conducted and the checking result of the absence or presence of cracking is indicated as follows: a symbol ○ denotes no cracking: a symbol x denotes the occurrence of cracking. The case that any cracking occurs during cold working and subsequent spinning could not be carried out is indicated by a symbol—.

TABLE 4

Table 4

| Run No. | Steel No. | Heat Treatment | Cross-Sectional Area Reduction Rate (%) | Absence or Presence of Cracking during Cold Working | Absesnce or Presence of Cracking during Spinning |
|---|---|---|---|---|---|
| A | 1 | None | 80 | X | — |
| B | 1 | Spheroidizing Annealing | 80 | ○ | ○ |
| C | 4 | None | 80 | ○ | X |
| D | 4 | Normalizing | 80 | ○ | ○ |
| E | 6 | None | 60 | ○ | X |

TABLE 4-continued

Table 4

| Run No. | Steel No. | Heat Treatment | Cross-Sectional Area Reduction Rate (%) | Absence or Presence of Cracking during Cold Working | Absesnce or Presence of Cracking during Spinning |
|---|---|---|---|---|---|
| F | 6 | Normalizing | 60 | ○ | ○ |
| G | 9 | None | 70 | X | — |
| H | 9 | Spheroidizing Annealing | 70 | ○ | ○ |
| I | 9 | Annealing | 70 | ○ | ○ |
| J | 10 | None | 75 | X | — |
| K | 10 | Spheroidizing Annealing | 75 | ○ | ○ |
| L | 12 | None | 70 | ○ | X |
| M | 12 | Normalizing | 70 | ○ | ○ |
| N | 14 | None | 75 | ○ | X |
| O | 14 | Normalizing | 75 | ○ | ○ |
| P | 18 | None | 80 | ○ | X |
| Q | 18 | Normalizing | 80 | ○ | ○ |
| R | 20 | None | 70 | X | — |
| S | 20 | Normalizing | 70 | ○ | ○ |
| T | 20 | Annealing | 80 | ○ | ○ |

As shown in Table 4, the normalizing treatment or the spheroidizing annealing treatment in association with cold working can prevent any cracking from occurring during cold working or spinning. It is evident that the heat treatment to be applied in the production method according to the present invention can improve cold workability remarkably.

INDUSTRIAL APPLICABILITY

Seamless steel tubes according to the present invention can have excellent cold workability, hardenability, toughness and torsion fatigue strength concurrently, thereby enabling not only to prevent any cracking from occurring when a reducing or spinning process for tube ends is applied to those tubes as the starting materials for making hollow drive shafts, but also to harden through the whole thickness from the outside surface to the inside surface of the steel tube and secure high toughness owing to the heat, treatment in association with the cold forming process. Thus, a longer service life of drive shafts can be achieved.

Therefore, seamless steel tubes according to the present invention are most suitable for hollow shaft blanks to make one-piece type hollow drive shafts and can be widely employed for automobile parts.

What is claimed is:

1. A seamless steel tube, comprising, in mass %, C: 0.30 to 0.50%, Si: not more than 0.5%, Mn: 0.3 to 2.0%, P: not more than 0.025%, S: not more than 0.005%, Cr: 0.15 to 1.0%, Al: 0.001 to 0.05%, Ti: 0.005 to 0.05%, N: not more than 0.02%, B: 0.0005 to 0.01% and O (oxygen): not more than 0.0050%, the balance being Fe and impurities, wherein Beff defined in an equation (a) or (b) as below is not less than 0.0001;

when $Neff = N - 14 \times Ti/47.9 \geqq 0$ where each of Ti, N and B designates its content, in mass %, $$Beff = B - 10.8 \times (N - 14 \times Ti/47.9)/14, \quad (a)$$

(b) likewise, when $Neff = N - 14 \times Ti/47.9 < 0$, $Beff = B$.

2. The seamless steel tube according to claim 1, further comprising, in mass %, one or more of elements which are to be selected from a group of Cu: 0.05 to 1%, Ni: 0.05 to 1% and Mo: 0.05 to 1%.

3. The seamless steel tube according to claim 1 or claim 2, further comprising, in mass %, one or more of V: 0.005 to 0.1%, Nb: 0.005 to 0.1% and Zr: 0.005 to 0.1%.

4. The seamless steel tube according to claim 1 or claim 2, further comprising, in mass %, one or more of elements which are selected from a group of Ca: 0.0005 to 0.01%, Mg: 0.0005 to 0.01% and REM: 0.0005 to 0.01%.

5. The seamless steel tube according to claim 3, further comprising, in mass %, one or more of elements which are selected from a group of Ca: 0.0005 to 0.01%, Mg: 0.0005 to 0.01% and REM: 0.0005 to 0.01%.

6. A method for producing a seamless steel tube in which cold working of not less than 5% in cross-sectional area reduction rate is applied to a steel tube, said steel tube being made by a tube making process applied to a material with chemical composition specified in claim 1 or claim 2, wherein annealing or normalizing is applied after said cold working, or alternatively spheroidizing annealing is applied prior to or after said cold working.

7. A method for producing a seamless steel tube in which cold working of not less than 5% in cross-sectional area reduction rate is applied to a steel tube, said steel tube being made by a tube making process applied to a material with chemical composition specified in claim 3, wherein annealing or normalizing is applied after said cold working, or alternatively spheroidizing annealing is applied prior to or after said cold working.

8. method for producing a seamless steel tube in which cold working of not less than 5% in cross-sectional area reduction rate is applied to a steel tube, said steel tube being made by a tube making process applied to a material with chemical composition specified in claim 4, wherein annealing or normalizing is applied after said cold working, or alternatively spheroidizing annealing is applied prior to or after said cold working.

* * * * *

UNITED STATES PATENT AND TRADEMARK OFFICE

CERTIFICATE OF CORRECTION

PATENT NO. : 7,316,143 B2
APPLICATION NO. : 11/592782
DATED : January 8, 2008
INVENTOR(S) : Kunio Kondo et al.

It is certified that error appears in the above-identified patent and that said Letters Patent is hereby corrected as shown below:

Claim 8, line 1, after the claim number and before "method", insert the word --A--.*

Signed and Sealed this

Thirteenth Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 7,316,143 B2
APPLICATION NO. : 11/592782
DATED : January 8, 2008
INVENTOR(S) : Kunio Kondo et al.

It is certified that error appears in the above-identified patent and that said Letters Patent is hereby corrected as shown below:

Column 18, Claim 8, line 57, after the claim number and before "method", insert the word --A--.*

This certificate supersedes the Certificate of Correction issued May 13, 2008.

Signed and Sealed this

Third Day of June, 2008

JON W. DUDAS
*Director of the United States Patent and Trademark Office*